United States Patent [19]

McKinnon et al.

[11] 4,358,113

[45] Nov. 9, 1982

[54] HOCKEY STICK

[76] Inventors: John D. McKinnon, 131 Pueblo Rd., Corona, Calif. 91720; Francis N. Maloney, 4455 Monitor Ct., Riverside, Calif. 92503; John S. Miller; James R. Miller, both of 3338 W. Castor St., Santa Ana, Calif. 92704

[21] Appl. No.: 233,921

[22] Filed: Feb. 12, 1981

[51] Int. Cl.[3] ..... A63B 59/14

[52] U.S. Cl. ..... 273/67 A; 273/DIG. 7; 264/241

[58] Field of Search ..... 273/67 R, 67 A, 73 R, 273/73 C, 73 F, 73 G, 73 J, 80.2, 167 R, 326, DIG. 7

[56] References Cited

U.S. PATENT DOCUMENTS

| | | | |
|---|---|---|---|
| 3,934,875 | 1/1976 | Easton et al. | 273/67 A |
| 4,084,818 | 4/1978 | Goupil et al. | 273/67 A |
| 4,086,115 | 4/1978 | Sweet et al. | 273/67 A X |

FOREIGN PATENT DOCUMENTS

| | | | |
|---|---|---|---|
| 896690 | 3/1972 | Canada | 273/67 A |
| 922750 | 3/1973 | Canada | 273/67 A |
| 2911512 | 10/1979 | Fed. Rep. of Germany | 273/67 A |
| 42515 | 4/1970 | Finland | 273/67 A |

*Primary Examiner*—Anton O. Oechsle

*Attorney, Agent, or Firm*—Francis X. LoJacono

[57] ABSTRACT

A hockey stick formed having a double-box beam shaft defining an elongated handle, and a molded laminated blade structure integrally molded to one end of the double-box beam shaft. The laminated blade is formed by molding a plastic core having laminated therein outer oppositely disposed preformed resin-impregnated web-like cloth sheets, and inner oppositely disposed unidirectional fiberglass-strip members positioned longitudinal of the main-body portion of the blade, the fiberglass strips being held in spaced relationship to each other by foam spacers, whereby a pair of elongated fiberglass rod members are interposed between a portion of the strips and the angularly disposed neck portion of the blade, and encapsulated within the plastic core, the rods extending outwardly to be integrally molded to the shaft.

4 Claims, 7 Drawing Figures

12
15
16
17
18
14
20
22
36
3
3
34
4
4
28
40
A
32
25
30
26
50
45
45a

HOCKEY STICK

BACKGROUND OF THE INVENTION

1. Field of the Invention

This invention relates generally to a hockey stick, but more particularly to a laminated blade which is integrally molded to a double-box beam shaft of the stick.

2. Description of the Prior Art

It is well understood in the art that various problems and difficulties are still being encountered in providing a suitable hockey stick that can withstand excessive damage, particularly the wear caused by abrasion as the butt side of the hockey blade scrapes or hits the ice.

There are many types of hockey sticks presently in use, but these have met with limited success. The most common hockey stick is the solid or laminated wood stick which has set the standards for weight, feel and reaction. Many types of plastic laminated sticks have also been tried which have generally been found to provide excellent strength characteristics. However, these laminated sticks establish weight, wear and feel characteristics that are unsuitable to most hockey players.

Thus, it is a goal to provide a unique hockey stick that comparably provides for the weight, feel and action as with the well-established wooden sticks, but without the problems of poor wear and breakage resistance.

As an example of the art, reference may be made to U.S. Pat. No. 4,059,269 which discloses a laminated blade having an inner core and various outer veneer strips. Another example is U.S. Pat. No. 4,086,115 which discloses a method of making a hockey stick having a handle or shaft formed from four continuous fiberglass strips, and a blade having a special tongue-connecting means.

SUMMARY OF THE INVENTION

In accordance with the invention claimed, a new and improved hockey stick is provided having an elongated double-box shaped beam shaft which is integrally molded at one end to a molded blade having two sets of laminated materials interposed within the main core body, a juxtaposed pair of fiberglass rods being angularly disposed along the inner core of the blade in order to define the heel and neck portion of the blade.

It is, therefore, an important object of the present invention to provide a synthetic hockey stick that is so constructed as to establish structural characteristics similar to the commonly known wood stick, yet further providing the ability to better withstand the abrasiveness of the ice.

It is another object of the invention to provide a new method of forming an integral hockey stick wherein the blade is molded to the end of the stick, and is further molded so as to include various laminated plastic sheets and/or strips to transfer a greater impact-and-stiffness sensitivity to the player.

It is still another object of the invention to provide a hockey stick that is basically simple and rugged in construction, but one that allows the player to have such a keen tactile perception that he does not have to look at the puck while skating.

A still further object of the invention is to provide outer layers of a web-like, open-weave cloth for skin and curvature stability and fracture resistance.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figures 1, 2, 3, 4, 5:
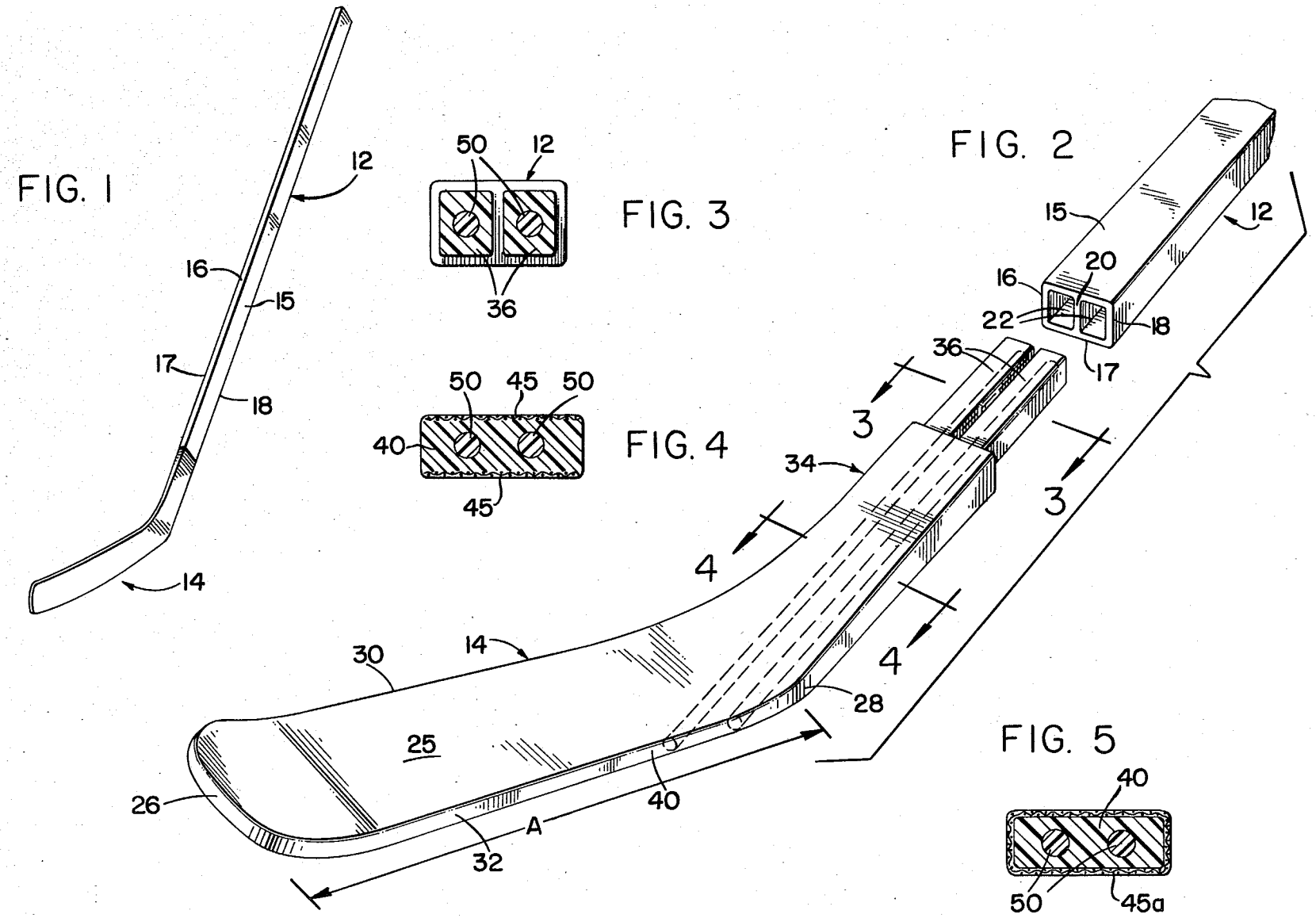
FIG. 1 is a perspective view of a hockey stick representing the present invention.
FIG. 2 is an exploded perspective view of the blade and connecting end of the shaft thereof.
FIG. 3 is an enlarged cross-sectional view taken substantially alone line 3—3 of FIG. 2, illustrating the extended rods and the plastic core material encapsulating the rods as they would be seen inside the double-box shaft.
FIG. 4 is an enlarged cross-sectional view taken along line 4—4 of FIG. 2.
FIG. 5 is an enlarged cross-sectional view similar to FIG. 4, showing an alternative embodiment wherein the outer fiberglass cloth is formed about the four sides of the blade.

Referring more particularly to FIG. 1, there is shown at 10 a hockey stick which basically comprises an elongated shaft 12 defining a handle, the lower end of the handle being integrally formed with a molded plastic blade having a predetermined curvature.

Shaft 12 is constructed so as to form an elongated double-box beam of unidirectional strips. The strips may be any suitable type impregnated within a resin-based system having a minimum of 10 m p.s.i. tensile strength, with an elongation factor between 2% and 7%, and including a high filler calcium carbonate of 40% to 50%.

The physical structure of the shaft comprises a substantially rectangular cross-section, as seen in FIG. 2, defined by four outer integrally formed walls 15, 16, 17 and 18, and including a centrally disposed strut wall 20 defining a pair of contiguous box channels 22. The inner strut wall thus provides for a rigid shaft when using a high filler content; otherwise, the shaft would be too flexible if it is formed in a single box-like arrangement as found in some devices known in the art.

Accordingly, the shaft constructed as described above will be held to the proximate specific gravity of an ashwood shaft, thus having flexural modules of between 5 to $6\times10^6$ with a tensile strength of at least 75 m, a normal pulltrusion specific gravity of 1.6, and a hardness of 65 barcoh. Thus, together with the novel blade (to be described hereinafter), the finished hockey stick 10 will weigh within a 50-gram range of most conventional wood sticks, but it will be much stiffer.

Blade 14 comprises a main-body blade portion 25 which includes the area from the blade tip 26 to the blade heel 28, the area being defined by "A" in FIG. 2.

The main-body blade portion 25 is perferably formed having a linear curve to better carry the puck (not shown) used in the hockey game. The general width configuration of the main body 25 is such that it is tapered from top to bottom, the top edge 30 being smaller in width than the lower edge 32, which is the area of contact with the ice.

Extending angularly upward from the heel portion 28 is a neck member 34 which is formed to include two juxtaposed mainstays 36 that extend outwardly from neck 34 so as to be disposed within respective box channels 22. Thus, it can be seen that blade 14 can be fitted to the connecting end of shaft 12 and secured therein by various suitable means, such as bonding. However, the preferred form of integrally mounting blade 14 to shaft 12 will be hereinafter described in the process of manufacturing the hockey stick 10.

Blade 14 is constructed having a basic resin core 40 in which outer side skins 42 of glass cloth or screen material are embedded. The shapes of the side skins are preformed to determine the overall configuration of the blade. That is, each skin member 42 comprises a cloth sheet with a loose, web-like, open weave having a body section 44 and an angularly disposed neck section 45 which defines the primary configuration of the blade 14, as previously described. There is sandwiched on the inner side of the outer skins 42 along the body section 44 an elongated strip or layer 46 of a thin fiberglass material, preferably consisting of unidirectional strips of pulltruded fiberglass, approximately one inch in width, having 150 m tensile and $9\times10^6$ flexural modular characteristics. These strips 46 extend lengthwise of the blade body from the tip area 26 to the heel portion 28, so as to overlap a pair of structural rods 50.

Figure 6:
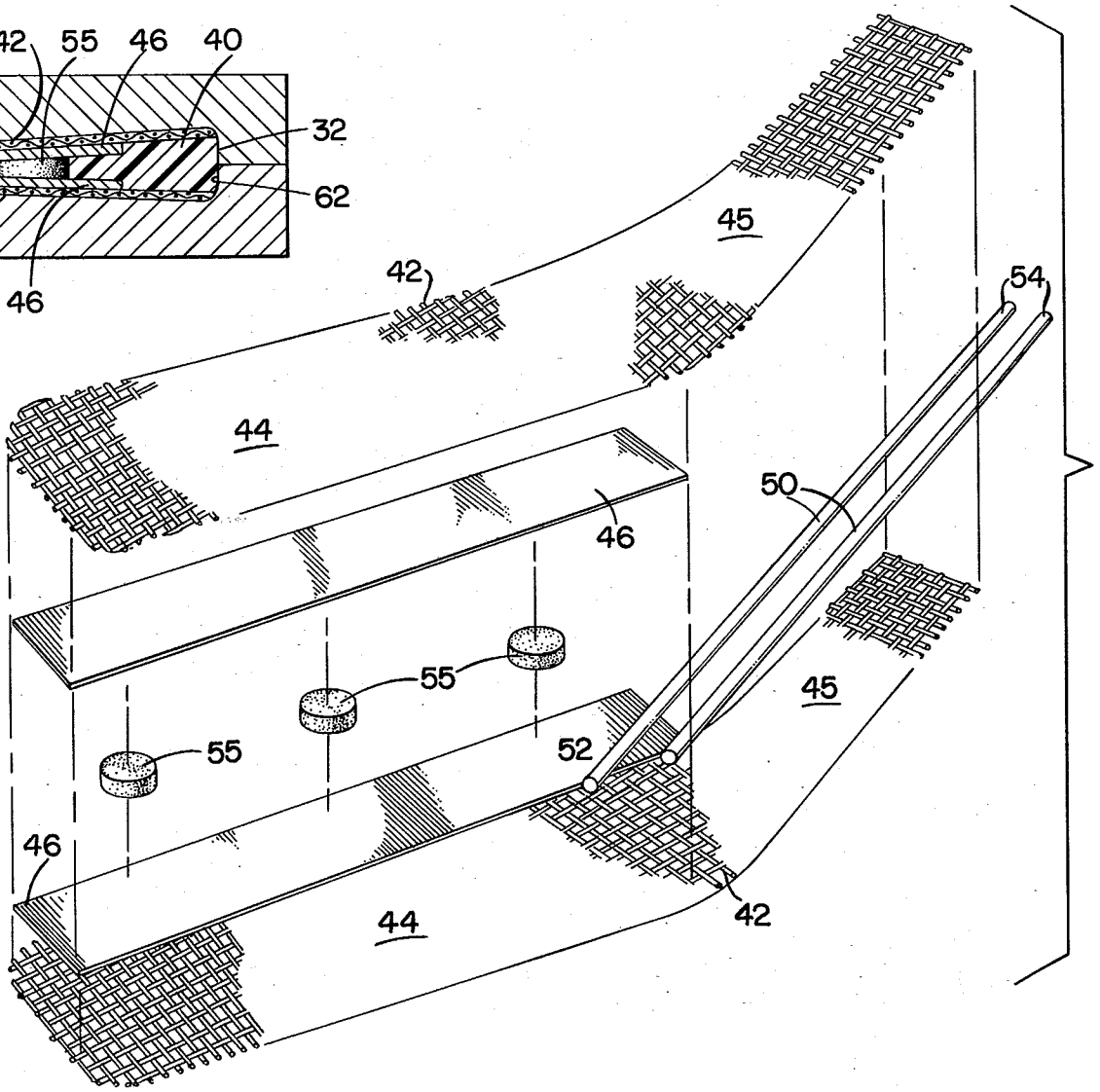
FIG. 6 is an exploded perspective view of the blade prior to being positioned within the mold structure.

Structural rods 50 as illustrated in FIGS. 2 and 6 are arranged in parallel relationship to each other, and are angularly disposed so as to be positioned longitudinally between each neck section 45 of the webbed skins 40. The inner ends 52 of each rod terminate at the heel portion 28 of blade 14; and the outer ends 54 project outwardly of the blade neck 34 approximately 2" to 5" so as to be encapsulated within the resin core material 40, the inner ends being further sandwiched between the ends of the layers 46. The two rods are formed of pulltruded fiberglass rods containing 75% to 80% glass by weight.

To allow for the injection of the resin core material, there is provided a plurality of spacers 55 made of a resilient material such as a foam plastic. These spacers are interposed between the laminated layers 46 so as to establish gaps or spaces therebetween of from ½" to 3/16" for injection clearance of the resin material 40.

As can be realized, blade 14 may be made as an individual part and then bonded to shaft 12; or, preferably, the blade may be molded to the connected end of shaft 12 to provide an integral structure heretofore not accomplished in the art.

The preferred method of forming the complete hockey stick comprises providing a mold structure 60 having a mold cavity 62 conforming to the predetermined configuration of blade 14, and including an open end adapted to receive the connecting end of shaft 12.

Sequentially positioned in the mold cavity in a sandwich-like form, the first web material 42 is placed in the cavity and the neck section 45 is arranged adjacent the one end of the mold. One of the thin elongated strips or layer members 46 is positioned on top of the body section 44. This is followed by locating the pair of glass rods 50 so that rod ends 52 start at the heel portion and extend towards the opening in the mold, whereby the opposite ends 54 of rods 50 can be received in the box opening 22 of shaft 12.

Figure 7:
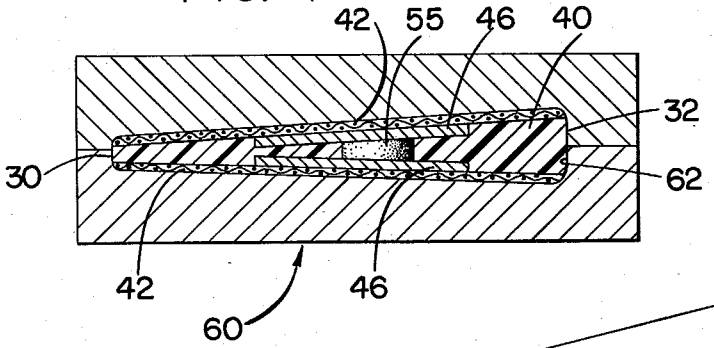
FIG. 7 is an enlarged cross-sectional view of the blade as it would be seen in the mold after the injection of the plastic core.

Prior to placing the second strip or layer 46 in the mold, sponge or foam spaces 55 are equally spaced along the first layer 46. Then the second layer 46 is positioned on spacers 55, as seen in FIG. 7. Because of the resiliency characteristics of spacers 55, they are readily deformable—but yet establish a space between the juxtaposed layers 46. The second outer webbed skin member 42 is positioned on the second layer 46.

Shaft 12 is positioned whereby the connecting end thereof is located in the mold opening so as to extend inwardly thereof to receive rod end 54. The rods extend approximately 2" to 3" within each opening 22 of the double-box structure.

When these steps are completed, a suitable resin (such as a nylon or polyurethane having 50 to 90 shore-D hardness, 5000 p.s.i. tensile-tear strength, with a specific gravity of 1.02, having a low temperature resistance of −80° F. and a heat distortion of 150° F.) is injected into the mold cavity 32, thereby forming the core of the blade, the resin being dispersed throughout the webbing of the outer skins 42 and filling the space between layers 46 provided by spacers 55. Resin core 40 further invades the box opening to approximately 2" to 3" so as to encapsulate the rod ends 54 disposed therein, whereby shaft 12 and blade 14 become an integral structure.

In applications where only the blade is to be formed, mold 60 would not be provided with an end opening to receive shaft 12.

FIG. 5 illustrates an embodiment wherein the web-like material **45*a*** is provided in one sheet and folded to cover all four sides of the blade.

It should be noted that, by extending rods 50 so as to form part of the heel portion 28, a protective means is established to prevent excessive wear to the heel area 28. Further, the web-like, preformed cloth material for members 45 may be pre-impregnated with epoxy, polyester, phenolic, resin, etc., and fully cured for optimum stiffness so that the cloth material will not wash during the injection of resin.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. An improved hockey stick comprising:

a double-box beam shaft defining an elongated handle having a central strut wall forming contiguous box channels therein;

a fabricated blade having a main blade-body portion and an angularly disposed integral neck portion;

a pair of juxtaposed mainstays extending outwardly from said neck portion and formed as an integral part thereof, each of said mainstays being disposed and secured in said respective box channels of said shaft, whereby said shaft abuts against said neck portion;

a pair of fiberglass rod members encapsulated within said neck portion of said blade and said respective mainstays, said rod members extending angularly upward from the lower contacting edge of said blade into said respective mainstays;

wherein said fabricated blade further comprises:

a core formed from a plastic resin;

a webbed plastic cloth material embedded about the outer surface of said plastic resin core, defining a hard protective skin for said blade;

a plurality of elongated layers of pulltruded unidirectional fiberglass strips laminated within said core and longitudinally disposed along said blade-body portion; and a plurality of resilient spacer members interposed between said strips to provide space between said strips, allowing said resin core to be received therein and thereby establishing a laminated blade body.

2. A hockey stick as recited in claim 1, wherein said webbed plastic cloth material defines a pair of skin sheets having the overall configuration of said blade, defining a body section and a neck section to respectively correspond to said blade-body portion and to said neck portion.

3. A hockey stick as recited in claim 2, wherein said skin sheets are formed from a fiberglass material impregnated with plastic selected from the group consisting of epoxy, polyester and phenolic.

4. A hockey stick as recited in claim 3, wherein said blade is formed having a linearly curved body portion, the width of said body portion being tapered in a cross-sectional configuration, and the bottom longitudinal edge of said body portion being wider than the upper longitudinal edge of said body portion.

* * * * *